US011142873B2

(12) United States Patent
Yu et al.

(10) Patent No.: US 11,142,873 B2
(45) Date of Patent: Oct. 12, 2021

(54) ARTIFICIAL TURF AND METHOD FOR PREPARING THE SAME

(71) Applicant: QINGDAO BELLINTURF INDUSTRIAL CO., LTD., Shandong (CN)

(72) Inventors: Kang Yu, Shandong (CN); Jiahui Zhou, Shandong (CN); Bo Yu, Shandong (CN); Faping Qin, Shandong (CN)

(73) Assignee: QINGDAO BELLINTURF INDUSTRIAL CO., LTD., Shandong (CN)

( * ) Notice: Subject to any disclaimer, the term of this patent is extended or adjusted under 35 U.S.C. 154(b) by 311 days.

(21) Appl. No.: 16/207,202

(22) Filed: Dec. 3, 2018

(65) Prior Publication Data

US 2020/0002899 A1 Jan. 2, 2020

(30) Foreign Application Priority Data

Jul. 2, 2018 (CN) ..... 201810708761.0

(51) Int. Cl.
*E01C 13/08* (2006.01)
*D05C 15/04* (2006.01)
(Continued)

(52) U.S. Cl.
CPC ..... *E01C 13/08* (2013.01); *D01D 5/22* (2013.01); *D01D 5/253* (2013.01); *D01F 1/10* (2013.01);
(Continued)

(58) Field of Classification Search
CPC ..... E01C 13/08; D06N 7/0065; D06N 2201/0263; Y10T 428/23957;
(Continued)

(56) References Cited

U.S. PATENT DOCUMENTS 3,332,828 A * 7/1967 Faria ..... D03D 25/00 428/17
3,346,916 A * 10/1967 Elbert ..... D01D 5/253 425/464
(Continued)

FOREIGN PATENT DOCUMENTS

AU 2011101368 A4 * 11/2011
CN 201751460 U 2/2011
(Continued)

OTHER PUBLICATIONS

CN 107190617 A translation, 2017.*
(Continued)

*Primary Examiner* — Cheryl Juska
(74) *Attorney, Agent, or Firm* — Yue (Robert) Xu; Apex Attorneys at Law, LLP

(57) ABSTRACT

The present invention relates to an artificial turf. In the present invention, nylon is used as the main material. Through selecting straight fibers and curve fibers with certain cross-sectional shapes, lengths and widths and using the straight fiber and curve fiber together, the obtained grass fibers not only have relatively good temperature resistance, but also good handfeel, wear resistance, anti-aging performance, grass fiber resilience, trampling resistance and grass uprightness.

10 Claims, 7 Drawing Sheets

(51) Int. Cl.

| | |
|---|---|
| ***D01D 5/22*** | (2006.01) |
| ***D01D 5/253*** | (2006.01) |
| ***D05C 17/02*** | (2006.01) |
| ***D06N 7/00*** | (2006.01) |
| ***D01F 6/90*** | (2006.01) |
| ***D01F 1/10*** | (2006.01) |

(52) U.S. Cl.
CPC ..... *D01F 6/90* (2013.01); *D05C 15/04* (2013.01); *D05C 17/026* (2013.01); *D06N 7/0065* (2013.01); *D06N 2201/0263* (2013.01); *D10B 2321/022* (2013.01); *D10B 2331/02* (2013.01); *D10B 2505/202* (2013.01); *Y10T 428/23957* (2015.04); *Y10T 428/23993* (2015.04)

(58) Field of Classification Search
CPC ..... Y10T 428/23993; D10B 2505/202; D10B 2331/02; D10B 2321/022; D05C 17/026; D05C 15/04; D01F 6/90; D01F 1/10; D01D 5/22; D01D 5/253
See application file for complete search history.

(56) References Cited

U.S. PATENT DOCUMENTS

| | | | | |
|---|---|---|---|---|
| 3,565,910 | A * | 2/1971 | Elbert et al. | C08K 3/24 524/88 |
| 5,973,013 | A * | 10/1999 | Igwe | C08L 77/02 521/49 |
| 2003/0099787 | A1* | 5/2003 | Fink | D02G 3/445 428/17 |
| 2006/0107880 | A1* | 5/2006 | Peeples | D05C 15/16 112/80.41 |
| 2008/0187689 | A1 | 8/2008 | Dierkens et al. | |
| 2009/0041956 | A1* | 2/2009 | Gilman | B32B 3/085 428/17 |
| 2010/0101678 | A1* | 4/2010 | Knapp | D03D 27/00 139/11 |
| 2013/0004683 | A1 | 1/2013 | Auguste et al. | |
| 2015/0051335 | A1* | 2/2015 | Cocquet | C08L 75/06 524/538 |
| 2015/0354147 | A1* | 12/2015 | Fowler | D05C 15/10 428/22 |
| 2016/0265170 | A1* | 9/2016 | Vachon | E01C 13/08 |
| 2019/0003132 | A1* | 1/2019 | Yu | A41G 1/009 |
| 2019/0345644 | A1* | 11/2019 | Ramakrishnan | D01F 1/10 |
| 2020/0165785 | A1* | 5/2020 | Sick | D01F 1/04 |

FOREIGN PATENT DOCUMENTS

| | | | | |
|---|---|---|---|---|
| CN | 105064170 | A * | 11/2015 | |
| CN | 107190617 | A * | 9/2017 | A41G 1/009 |
| CN | 207376400 | U | 5/2018 | |
| CN | 110527285 | A * | 12/2019 | |
| DE | 19829928 | A1 * | 1/2000 | D01F 6/90 |
| EP | 3228737 | A1 | 10/2017 | |
| JP | 5960557 | B2 | 8/2016 | |
| KR | 1073966 | B1 * | 10/2011 | D01F 6/90 |
| WO | WO-2009005375 | A1 * | 1/2009 | D01D 5/253 |

OTHER PUBLICATIONS

DE 198299928 A1 translation, 2000.*
First Examination Report dated Jan. 13, 2020 for Australian patent application No. 2018271323, 6 pages.

* cited by examiner

ARTIFICIAL TURF AND METHOD FOR PREPARING THE SAME

CROSS REFERENCE TO RELATED APPLICATIONS

This application claims the priority of Chinese Patent Application No. 201810708761.0, filed on Jul. 2, 2018, and titled with "ARTIFICIAL TURF AND METHOD FOR PREPARING THE SAME", and the disclosures of which are hereby incorporated by reference.

FIELD

The present disclosure relates to the field of artificial turf technology, specifically to an artificial turf and method for preparing the same.

BACKGROUND

Since it was invented in the 1960s, artificial turf has been rapidly developing because of advantages such as exquisite and uniform appearance, excellent performance, long service life, low maintenance cost, weather proof, safe and comfortable properties, environmental friendly materials, and celerity and facility in actualizing. At present, especially in some sports grounds, such as basketball, football, tennis, golf and other courts, luxury hotels, hanging gardens and villa courtyards, the leisure artificial turf has been used in large quantities, and it can be said that the market demand is getting bigger and bigger. Similarly, with the emergence of new technologies, people have put forward higher and higher requirements for the performance and quality of the grass fibers of the artificial turf.

The main raw materials of the conventional artificial turf are polyethylene (PE) and polypropylene (PP). However, the products made from polyethylene and polypropylene have poor temperature resistance, which can only withstand temperature of 95° C., and the actual surface temperature under direct sunlight can reach 120° C. or higher. The high temperature area not only requires high temperature resistance, but also has high requirements on wear resistance, anti-aging performance, grass fiber resilience, trampling resistance, grass uprightness and other performances of the products. However, the conventional products made from the polyethylene and polypropylene cannot meet these requirements.

SUMMARY

In view of this, an object of the present disclosure is to provide an artificial turf and the method for preparing the same. The artificial turf provided by the present disclosure not only has good high temperature resistance, but also has good wear resistance, anti-aging performance, grass fiber resilience, trampling resistance and grass uprightness.

The present disclosure provides an artificial turf, comprising a base mat, artificial grass fibers clustered on the base mat and a backing layer adhered on the back side of the base mat, wherein the artificial grass fiber comprises a straight fiber and a curve fiber, and the material of the straight fiber is PA, wherein the specific type of PA includes, but is not limited to one or more selected from PA6, PA66, PA1010 and ST801. The material of the curve fiber is at least one selected from PA and PP, wherein the specific type of PA includes, but is not limited to one or more selected from PA6, PA66, PA1010 and ST801. The PP is one or more selected from PPY24, PPZ30, PPT30 and PPT03.

Preferably, the straight fiber is in at least one cross-sectional shape, and the curve fiber is in at least one cross-sectional shape.

Preferably, the cross-sectional shape of the straight fiber is one or more selected from diamond shape, olive shape, rectangle, triangle, double-diamond shape, wave shape, ribbed shape, three-ribbed shape, clover shape, hollow shape, C shape, D shape, X shape, S shape, W shape, V shape, U shape and M shape, and the straight fiber also may be a net-like fiber; the cross-sectional shape of the curve fiber is one or more selected from rectangle, diamond shape, olive shape and ribbed shape; and the straight fiber and/or the curve fiber have a bright and/or matt surface effect.

Preferably, the cross-sectional shape of the straight fiber is diamond and/or olive shape, and the lengths of two diagonals of the diamond shape are respectively from 0.1 to 0.39 mm and from 1.0 to 1.8 mm, and the olive shape has a length of 1.2 to 2.0 mm and a diameter of 0.17 to 0.36 mm; the cross-sectional shape of the curve fiber is selected from olive shape and/or ribbed shape, and the ribbed shape is one or more selected from single-ribbed shape, double-ribbed shape, multiple-ribbed shape and connected-ribbed shape, and the olive shape has a length of 0.5 to 1.05 mm and a diameter of 0.1 to 0.26 mm, and the ribbed shape has a length of 0.6 to 0.95 mm and a width of 0.16 to 0.27 mm.

Preferably, the straight fiber has a length of 12 to 60 mm, and a single fiber denier of 500 to 20001 D; and the curve fiber has a natural length of 8 to 30 mmm and a single fiber denier of 250 to 1100 D; and the amount ratio of the straight fiber in use to the curve fiber in use is 1:1.

Preferably, the density of the artificial grass fiber is from 7,560 to 25,200 tufts/$m^2$, the number of the artificial grass fibers is from 120 to 240 tufts/m, and the stitch length is ⅜ or ⅝ inch.

Preferably, the artificial grass fibers have at least two colors.

Preferably, the straight fiber is made from a material comprising the following raw materials parts by mass:

| | |
|---|---|
| PA | 70 to 90 parts; |
| Color master batch or temperature resistance master batch | 2 to 8 parts; |
| PA-MDI/PTMG thermoplastic elastomer | 3 to 10 parts; |
| Functional master batch | 2 to 10 parts; |
| Glass fiber toughening agent | 5 to 10 parts; |
| Processing agent | 1 to 3 parts. |

Preferably, the functional master batch is obtained by mixing and granulating a material comprising the following raw materials by weight percentage;

| | |
|---|---|
| Polyolefin resin | 50 wt % to 80 wt %; |
| Light stabilizer | 1 wt % to 10 wt %; |
| Antioxidant | 1 wt % to 10 wt %; |
| Antistatic agent | 1 wt % to 15 wt %; |
| Plasticizer | 0.5 wt % to 5 wt %; |

and the processing agent is one or more selected from silicone polymers and fluoropolymers, or a mixture thereof which mainly plays a role in maintaining, the equipment.

Preferably, the method for preparing the straight fibers is:

mixing PA, the color master batch or the temperature resistance master batch, PA-MDI/PTMG thermoplastic elastomer, the glass fiber toughening agent and the processing agent, melting, extruding and thereafter cooling to obtain primary fibers;

subjecting the primary fibers to softening, drawing, retracting, setting and rolling to obtain the straight fibers; the draw ratio of the drawing is from 3 to 4.

Preferably, the curve fiber is made from a material comprising the following raw materials parts by mass:

| | |
|---|---|
| PA or PP | 60 to 98 parts; |
| Color master batch | 2 to 6 parts; |
| Glass fiber toughening agent | 3 to 7 parts; |
| Processing agent | 1 to 5 parts. |

Preferably, the method for preparing the curve fibers is:

mixing PA or PP, the color master batch, the glass fiber toughening agent and the processing agent, melting, extruding and thereafter cooling to obtain primary fibers;

subjecting the primary fibers to softening and drawing, deformation and rolling to obtain the curve fibers.

The present disclosure further provides a method for preparing the artificial turf, comprising:

twisting the artificial grass fibers, clustering the artificial grass fibers on the base mat, applying an adhesive and then drying to obtain the artificial turf.

Comparing with the conventional art, the present disclosure provides an artificial turf, comprising a base mat, artificial grass fibers clustered on the base mat and a backing layer adhered to the back side of the base mat, wherein the artificial grass fiber comprises a straight fiber and a curve fiber, and the material of the straight fiber is PA, and the material of the curve fiber is at least one selected from PA and PP. The present disclosure uses nylon as the main material, and the straight fibers and the curve fibers cooperate with each other, so that the obtained grass fibers not only have relatively good temperature resistance, but also have good wear resistance, anti-aging performance, grass fiber resilience, trampling resistance and grass uprightness at the same time.

DETAILED DESCRIPTION

The present disclosure provides an artificial turf, comprising a base mat, artificial grass fibers clustered on the base mat and a backing layer adhered to the back side of the base mat, wherein the artificial grass fiber comprises a straight fiber and a curve fiber, and the material of the straight fiber is PA, and the material of the curve fiber is at least one selected from PA and PP.

The artificial turf provide by the present disclosure comprises a base mat. There is no special restriction on the type of the base mat in the present disclosure, and it can be the base mat suitable for the artificial turf well known to one of ordinary skill in the art.

The artificial turf provided by the present disclosure further comprises artificial grass fibers clustered on the base mat. In the present disclosure, the artificial grass fibers comprise straight fibers and curve fibers. The material of the straight fiber is PA, and the material of the curve fiber is at least one selected from PA and PP. The material of the straight fiber is PA, wherein the specific type of PA includes, but is not limited to one or more selected from PA6, PA66, PA1010 and ST801. The material of the curve fiber is at least one selected from PA and PR wherein the specific type of PA includes, but is not limited to one or more selected from PA6, PA66, PA1010 and ST801, The PP is one or more selected from PPY24, PPZ30, PPT30 and PPT03.

In the present disclosure, the straight fibers comprise at least one cross-sectional shape, and the curve fibers comprise at least one cross-sectional shape.

The cross-sectional shape of the straight fiber is one or more selected from diamond shape, olive shape, rectangle, triangle, double-diamond shape, wave shape, ribbed shape, three-ribbed shape, clover shape, hollow shape, C shape, D shape, X shape, S shape, W shape, V shape, U shape and M shape, and the straight fiber also may be a net-like fiber.

Figure 1:
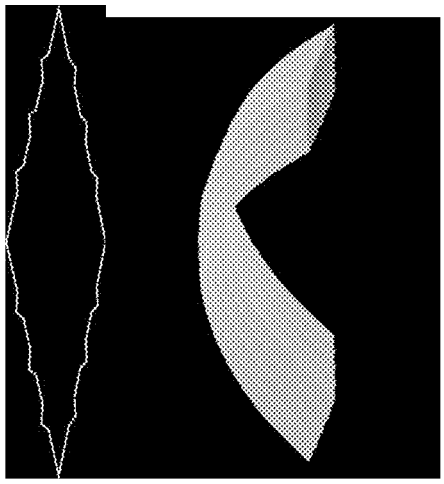
FIG. 1 is a cross-sectional schematic diagram (left) and a stereogram (right) of the straight fiber with a diamond cross-sectional shape provided by the present disclosure.
Figure 2:
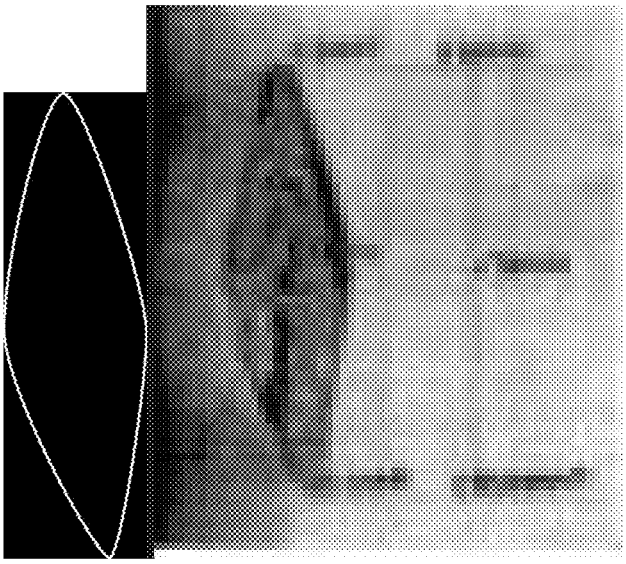
FIG. 2 is a cross-sectional schematic diagram (left) and a microscope graph (right) of the straight fiber with an olive cross-sectional shape provided by the present disclosure.

In some specific embodiments of the present disclosure, the cross-sectional shape of the straight fiber is diamond and/or olive shape, and the lengths of two diagonals of the diamond shape are respectively from 0.1 to 0.39 mm and from 1.0 to 1.8 mm, and the olive shape has a length of 1.2 to 2.0 mm and a diameter of 0.17 to 0.36 mm. Reference is made to FIG. 1, FIG. 1 is a cross-sectional schematic diagram (left) and a stereogram (right) of the straight fiber with a diamond cross-sectional shape provided by the present disclosure. It can be concluded from FIG. 1 that there are numerous vertical stripes set on the surface of the artificial grass fiber, simulating the veins of the natural grass. FIG. 2 is a cross-sectional schematic diagram (left) and a microscope graph (right) of the straight fiber with an olive cross-sectional shape provided by the present disclosure.

Figure 3:
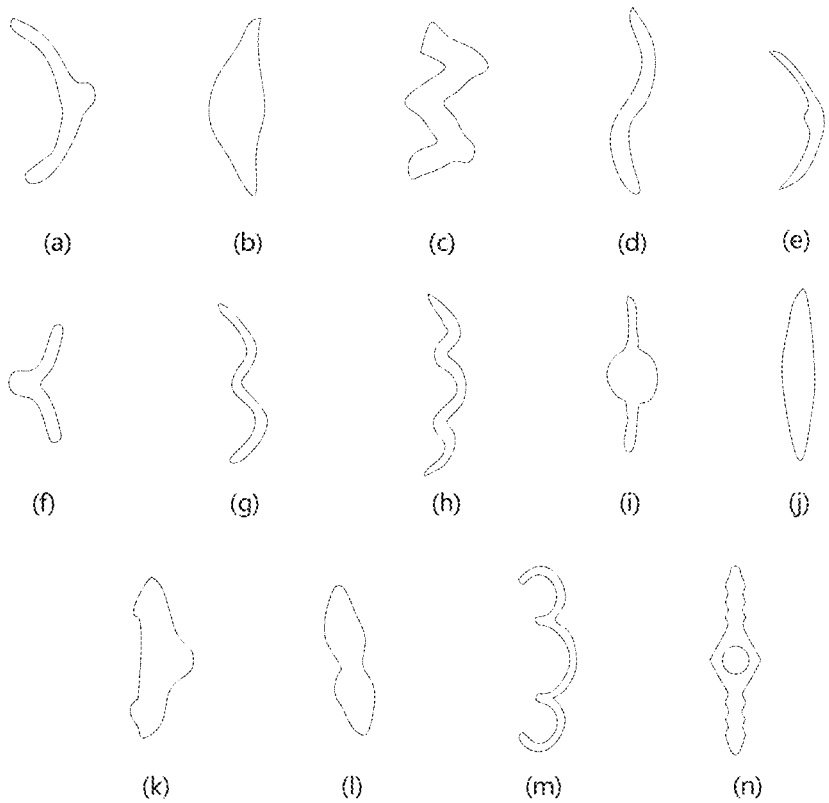
FIG. 3 shows the cross-sectional shapes suitable for the straight fiber of the artificial grass fiber provided by the present disclosure.

Reference is made to FIG. 3, which shows the cross-sectional shapes suitable for the straight fiber of the artificial grass fiber provided by the present disclosure. In some specific embodiments of the present disclosure, the cross-sectional shape of the straight fiber may be one or more selected from rectangle, triangle, double-diamond (l), wave shape (h), ribbed shape (i), three-ribbed shape (k), clover shape (m), hollow shape (n), C shape (a), D shape (b), X shape, S shape (d), W shape (g), V shape (f), U shape (e) and M shape (c).

In FIG. 3, the C shape (a) has a cross-sectional shape with an outer contour of letter C and the outer side of which can be provided with vertical ribs. The D shape (b) has a cross-sectional shape with an outer contour of letter D and the outer side of which is relatively smooth. The M shape (c) has a cross-sectional shape with an outer contour of letter M and of which the edge is relatively sharp. The S shape (d) has a cross-sectional shape with an outer contour of letter S and is integrally relatively thin and relatively smooth. The U shape (e) has a cross-sectional shape with an outer contour of letter U and the inner side of which can be provided with vertical ribs. The V shape (f) has a cross-sectional shape with an outer contour of V shape and the outer side can be provided with vertical ribs. The W shape (g) and wave shape (g) respectively have cross-sectional shapes with outer contours that curve multiple times and are integrally relatively thin and relatively smooth. The ribbed shape (i) has a cross-sectional shape with an outer contour of two relatively thin ends and a relatively thick vertical rib can be provided in the middle. The olive shape (j) has a cross-sectional shape with an outer contour of olive shape and is integrally smooth. The three-ribbed shape (k) has a cross-sectional shape with an outer contour with two vertical ribs provided on one side and one vertical rib provided on the other side. The clover shape (m) has a cross-sectional shape with an outer contour formed by three circular arcs connected end to end. The hollow shape (n) has a cross-sectional shape with an outer contour that two ends are relatively thin and a relatively thick vertical rib is disposed in the middle, and the vertical rib is hollow.

Figure 4:
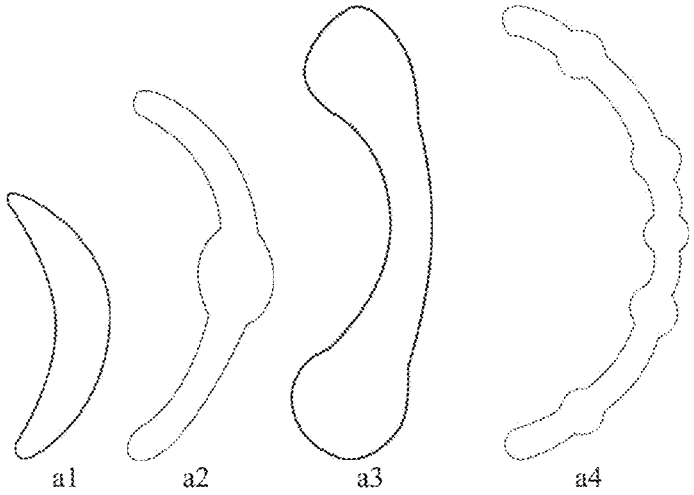
FIG. 4 is a schematic diagram of the C shape cross section of the straight fiber provided by the present disclosure.

In addition, the cross-sectional shape of the straight fiber also comprises C shape (a1 to a4). Reference is made to FIG. 4, which is a schematic diagram of the C shape cross sections of the straight fiber provided by the present disclosure. a1 is a cross-sectional shape with an outer contour of letter C and smooth edge. a2 is a cross-sectional shape with an outer contour of letter C and a vertical rib can be provided in the middle of the C shape. a3 is a cross-sectional shape with an outer contour of letter C and relatively thick vertical ribs can be provided on the two ends of the C shape. a4 is a cross-sectional shape with an outer contour of letter C which is integrally relatively thin and multiple vertical ribs are provided.

Figure 5:
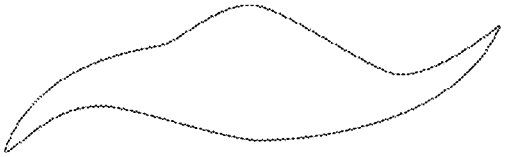
FIG. 5 is a schematic diagram of the double-C shape cross section of the straight fiber provided by the present disclosure.

In some specific embodiments, the cross-sectional shape of the straight fiber is a double-C shape. Reference is made to FIG. 5, which is a schematic diagram of the double-C shape cross section of the straight fiber provided by the present disclosure. Wherein, the double-C shape has a cross-sectional shape in which two letter C shape circular arcs are connected and face two opposite directions.

Figure 6:
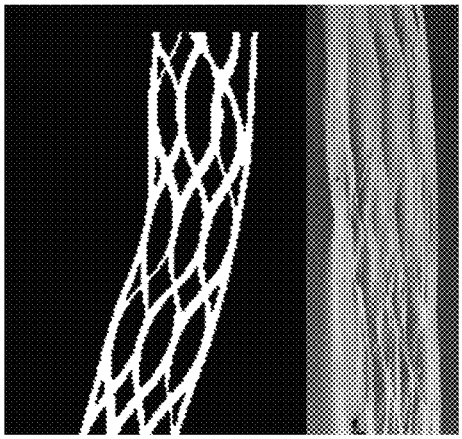
FIG. 6 is the structural diagram of a net-like fiber.

In some specific embodiments, the straight fiber may be a net-like fiber. Reference is made to FIG. 6, which comprises a structural diagram of the net-like fiber (left) and a photo of the open net-like fiber (right).

The artificial grass fibers provided by the present disclosure also include curve fibers. The cross-sectional shape of the curve fiber is one or more selected from rectangle, diamond shape, olive shape and ribbed shape. The cross-sectional shape of the curve fiber is selected from olive shape and/or ribbed shape, and the ribbed shape is one or more selected from single-ribbed shape, double-ribbed shape, multiple-ribbed shape and connected-ribbed shape.

Wherein, the rectangle shape has a cross-sectional shape with an outer contour of rectangle and four relatively sharp angles. The olive shape has a cross-sectional shape with an outer contour of olive and integrally smooth edge. The ribbed shape has a cross-sectional shape with an outer contour of two relatively thin ends and more than one relatively thick vertical ribs provided in the middle. Wherein, the ribbed shape is one or more selected from single-ribbed shape, double-ribbed shape and multiple-ribbed shape. The single-ribbed shape has a cross-sectional shape with an outer contour of two relatively thin ends and one relatively thick vertical rib provided in the middle of the shape. The double-ribbed shape has a cross-sectional shape with an outer contour of two relatively thin ends and two relatively thick vertical ribs not connected to each other and in the middle of the shape. The multiple-ribbed shape has a cross-sectional shape with an outer contour of two relatively thin ends and more than 3 relatively thick vertical ribs not connected to each other and in the middle of the shape. The connected-ribbed shape (which is also known as cloned shape) has a cross-sectional shape with an outer contour of two relatively thin ends and more than 3 relatively thick vertical ribs connected to each other and in the middle of the shape.

The olive shape has a length of 0.5 to 1.05 mm and a diameter of 0.1 to 0.26 mm, and the ribbed shape has a length of 0.6 to 0.95 mm and a width of 0.16 to 0.27 mm. The length of the ribbed shape is the length of the line connecting the two ends of the outer contour, and the width of the ribbed shape is the diameter of the vertical rib.

Figure 7:
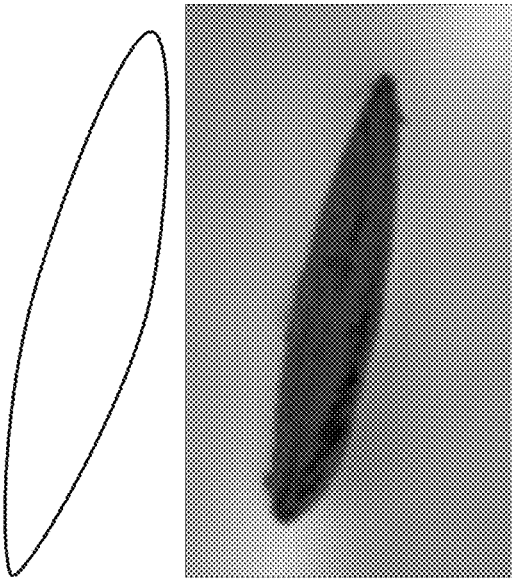
FIG. 7 is the cross-sectional schematic diagram (left) and microscope graph (right) of the curve fiber with an olive cross-sectional shape.
Figure 8:
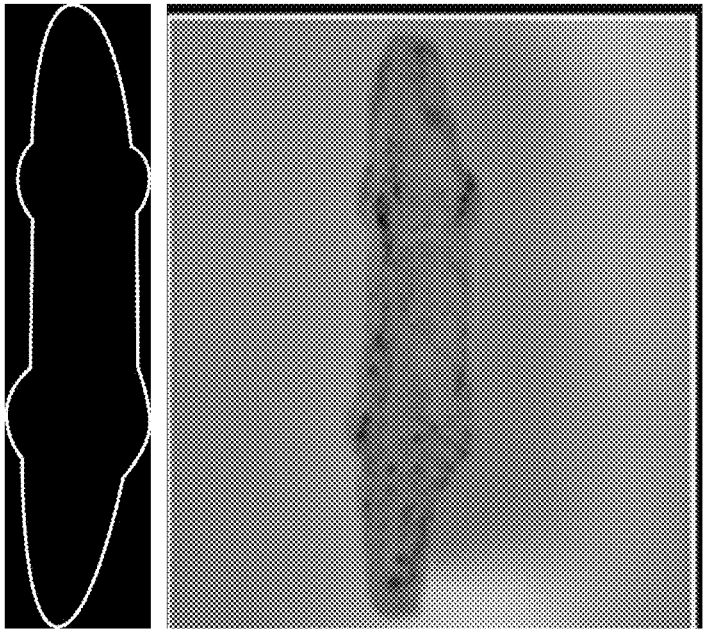
FIG. 8 is the cross-sectional schematic diagram (left) and microscope graph (right) of the curve fiber with a double-ribbed cross-sectional shape.

Reference is made to FIG. 7, which is the cross-sectional schematic diagram (left) and microscope graph (right) of the curve fiber with an olive cross-sectional shape. FIG. 8 is the cross-sectional schematic diagram (left) and microscope graph (right) of the curve fiber with a double-ribbed shape cross-sectional shape. Wherein, the double-ribbed type is a shape in which two vertical ribs are provided.

Figure 9:
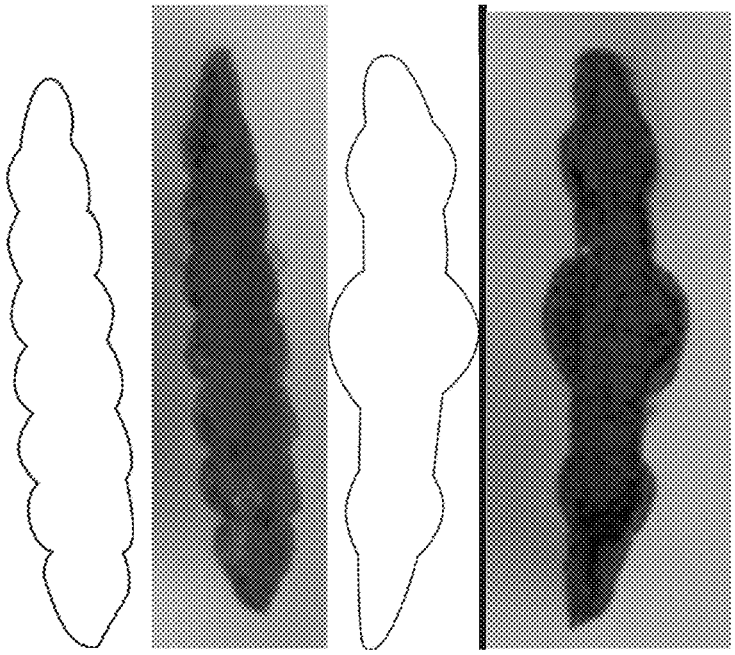
FIG. 9 shows the suitable cross-sectional shapes for the curve fibers of the artificial turf provided by the present disclosure.

Reference is made to FIG. 9, which shows the suitable cross-sectional shapes for the curve fiber of the artificial turf provided by the present disclosure. In FIG. 9, from left to right, there are successively a cross-sectional schematic diagram of the curve fiber with a cross-sectional shape of cloned shape, a microscope graph of the curve fiber with a cross-sectional shape of cloned shape, a cross-sectional schematic diagram of the curve fiber with a cross-sectional shape of multiple-ribbed shape and a microscope graph of the curve fiber with a cross-sectional shape of multiple-ribbed shape.

The straight fiber and/or curve fiber have a bright and/or matt surface effect which can be chosen according to the actual needs.

In the present disclosure, the straight fiber has a length of 12 to 60 mm, and a single fiber denier of 500 to 2000 D; and the curve fiber has a natural length of 8 to 30 mmm and a single fiber denier of 250 to 1100 D.

In some embodiments of the present disclosure, the straight fiber has a cross section of diamond and/or olive shape and the curve fiber has a cross-sectional shape of olive shape and/or double-ribbed shape, which cooperate together, and by controlling sizes of the straight fiber and curve fiber, the temperature resistance, wear resistance, anti-aging performance, fiber resilience, trampling resistance and grass uprightness of the turf are obviously improved comparing with the fiber with other cross-sectional shapes and sizes.

Figure 10:
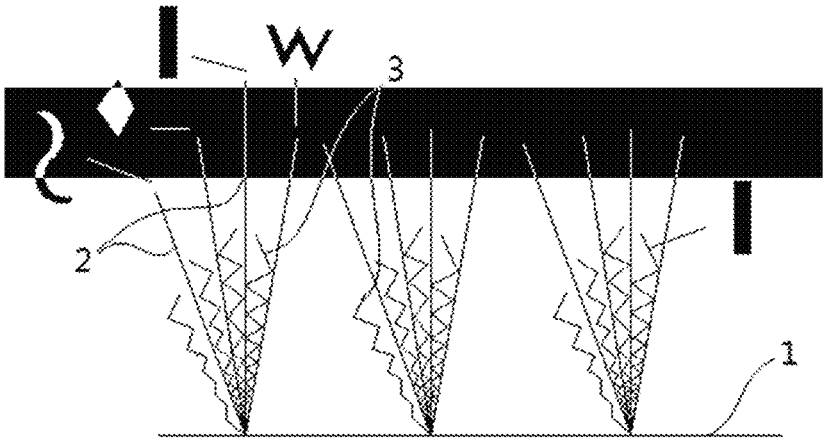
FIG. 10 is the structural diagram 1 of a combination of the straight fibers and the curve fibers.

The straight fibers and the curve fibers may be ply-twisted, or separately twisted. Thereafter, with a tufting machine, the twisted straight fibers and curve fibers are clustered on the base mat according to the predetermined parameters such as grass height, stitch length and so on, giving a semi-finished product of the artificial turf. Wherein, the upper part of the semi-finished product is the straight fibers and the lower part is the curve fibers. Reference is made to FIG. 10, which is the structural diagram 1 of a combination of the straight fibers and the curve fibers.

Figure 11:
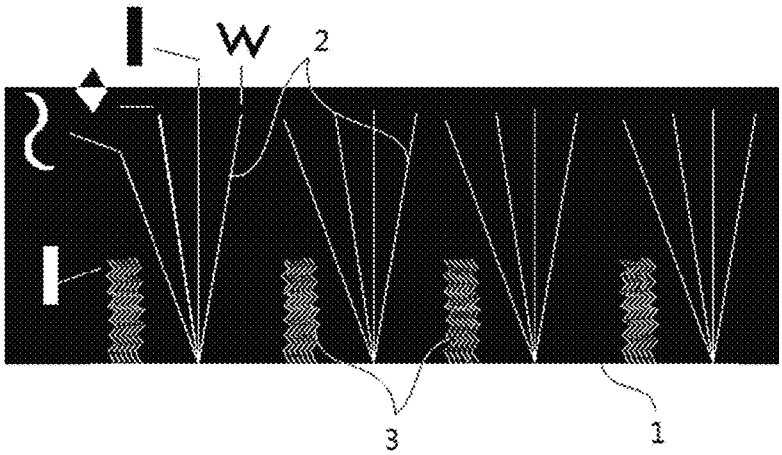
FIG. 11 is the structural diagram 2 of a combination of the straight fibers and the curve fibers.

The straight fibers and the curve fibers can be independently clustered and then arranged in an interlaced manner. Reference is made to FIG. 11, which is the structural diagram 2 of a combination of the straight fibers and the curve fibers.

Figure 12:
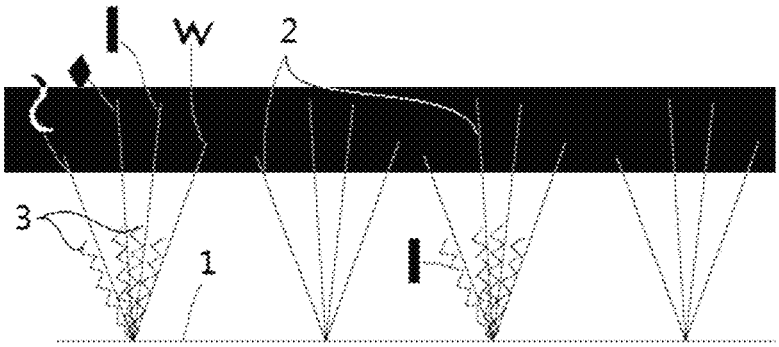
FIG. 12 is the structural diagram 3 of a combination of the straight fibers and the curve fibers.

Or, the straight fibers and the curve fibers are clustered together and then arranged in an interlaced manner with straight fibers. Reference is made to FIG. 12, which is the structural diagram 3 of a combination of the straight fibers and the curve fibers;

or, the straight fibers and the curve fibers are clustered together and then arranged in an interlaced manner with the curve fibers;

or, the straight fibers and the curve fibers are clustered together and then arranged in an interlaced manner with the straight fibers and the curve fibers, respectively.

In the present disclosure, the turf density of the artificial grass fibers is from 7,560 to 25,200 tufts/$m^2$. If the turf density of the product is lower than this range, the wear resistance of the grass fibers cannot meet the requirements; if the tuft density of the product is higher than this range, the heat emission is bad and the temperature resistance cannot meet the requirements, and the handfeel is a little bit hard. The number of the artificial grass fibers is from 120 to 240 tufts/m, and the stitch length is ⅜ or ⅝ inch.

In the present disclosure, the artificial grass fibers have at least two colors, and the color may be adjusted according to the need of court, season and use.

In the present disclosure, the straight fiber is made from a material comprising the following raw materials parts by mass:

| | |
|---|---|
| PA | 70 to 90 parts; |
| Color master batch or temperature resistance master batch | 2 to 8 parts; |
| PA-MDI/PTMG thermoplastic elastomer | 3 to 10 parts; |
| Functional master batch | 2 to 10 parts; |
| Glass fiber toughening agent | 5 to 10 parts; |
| Processing agent | 1 to 3 parts. |

Therein, in some embodiments of the present disclosure, the straight fiber is made from a material comprising the following raw materials parts by mass:

| | |
|---|---|
| PA | 70 to 90 parts; |
| Color master batch | 2 to 5 parts; |
| PA-MDI/PTMG thermoplastic elastomer | 3 to 10 parts; |
| Functional master batch | 2 to 10 parts; |
| Glass fiber toughening agent | 5 to 10 parts; |
| Processing agent | 1 to 3 parts. |

In other embodiments of the present disclosure, the straight fiber is made from a material comprising the following raw materials parts by mass:

| | |
|---|---|
| PA | 70 to 90 parts; |
| Temperature resistance master hatch | 4 to 8 parts; |
| PA-MDI/PTMG thermoplastic elastomer | 3 to 10 parts; |
| Functional master batch | 2 to 10 parts; |
| Glass fiber toughening agent | 5 to 10 parts; |
| Processing agent | 1 to 3 parts. |

Therein, the processing agent is one or more selected from silicone polymers and fluoropolymers, which mainly plays a role in maintaining the equipment.

The functional master batch is obtained by mixing and granulating a material comprising the following raw materials by weight percentage:

| | |
|---|---|
| Polyolefin resin | 50 wt % to 80 wt %; |
| Light stabilizer | 1 wt % to 10 wt %; |
| Antioxidant | 1 wt % to 10 wt %; |
| Antistatic agent | 1 wt % to 15 wt %; |
| Plasticizer | 0.5 wt % to 5 wt %. |

The polyolefin resin is purchased from Jilin Petrochemical (No. 7042), the light stabilizer is phenyl salicylate, the antioxidant is tris-(2,4-di-test-butyl-phenyl)-phosphite, the antistatic agent is dimethyl octadecyl hedroxy ethyl ammonium nitrate and the plasticizer is di(2-ethylhexyl) phthalate.

Comparing with straight fiber prepared with raw materials of other species and amounts, the straight fiber prepared with the raw materials of the above species and amounts of the present disclosure not only has relatively good temperature resistance, but also has good wear resistance, anti-aging performance, grass fiber resilience, trampling resistance and grass uprightness at the same time.

The method for preparing the straight fiber is:

mixing PA, the color master batch or the temperature resistance master batch, PA-MDI/PTMG thermoplastic elastomer, the glass fiber toughening agent and the processing agent, melting, extruding and thereafter cooling to obtain primary fibers;

subjecting the primary fibers to softening, drawing, shrinkage, setting and rolling to obtain the straight fibers; the draw ratio of the drawing is from 3 to 4.

Figure 13:
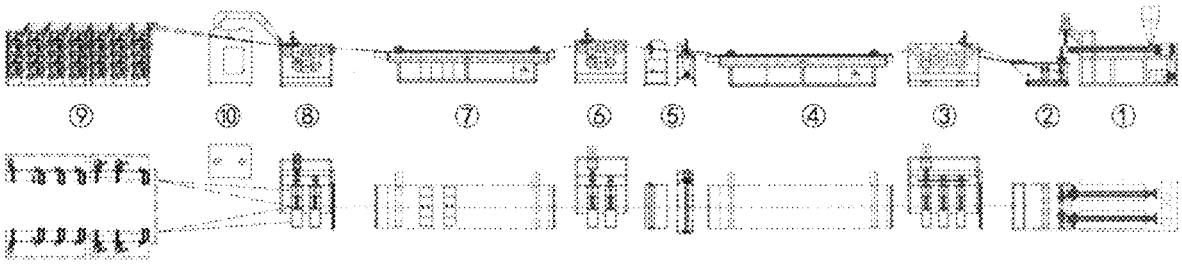
FIG. 13 is the process flow chart of preparing the straight fiber.

The method for preparing the straight fibers will be illustrated hereinafter in conjunction with the drawing. Reference is made to FIG. 13, which is the process flow chart of preparing the straight fibers.

Step I: Melting and Extruding (1) The nylon master batch PA, color master batch or temperature resistance master batch, PA-MDI/PTMG thermoplastic elastomer, GF (glass fiber) toughening agent and process aid are mixed in proportion and transferred into the screw ① through a hopper for melting and mixing, and the resultant is uniformly and continuously extruded from the nozzles at the head of the mold.

(2) The extruded material in viscous state is put into a cooling water tank ② for cooling to form primary fibers which is the precursor of the single fiber.

(3) The primary fibers are pulled out from the cooling water tank to the drawing roller ③, and then arranged tidily in the separating groove of the cooling water tank.

Comment:

1. The aspect ratio of the screw being used in preparing the artificial turf is higher than 30 and the melting and extruding temperature is from 160 to 260° C.

2. During the single fiber extruding process for preparing the artificial turf of the present method, the flow rate of the melted polyolefin resin is kept from 1 to 5 g/10 min.

Step II: Softening and Drawing (1) The primary fibers at the traction unit are sucked into the single-fiber collecting tank ⑩ through hot water tank ④, dehumidifier ⑤, draft roller ⑥, hot water tank ⑦ and setting roller ⑧ in sequence.

(2) The speeds gradually increase from the drawing roller ③ to drawing roller ⑥, and the primary fibers are subjected to drawing to forming a single fiber.

(3) During the drawing process, the primary fibers are softened through the hot water tank ④, so that it can be uniformly and fully drawed, reducing the fracture of primary fibers during the drawing process.

(4) The single fiber enters the dehumidifier ⑤ to remove the water on the surface to prevent the quality instability caused by unevenly heating during setting due to the water on the surface.

Comment: In the drawing process for preparing the artificial turf of the present disclosure, the draw ratio is from 3 to 4, and the temperature of the hot water tank is between 70 and 100° C.

Step III: Retracting and Setting

The speeds gradually decrease from the draft roller ⑥ to the setting roller ⑧, and the single fiber is subjected to retracting and setting through the oven ⑦, which give the fibers certain properties.

Comment: In the single fiber setting process for preparing the artificial grass fibers of the present disclosure, the retraction ratio is from 0.65 to 1, and the temperature of the oven is between 80 and 140° C.

Step IV: Rolling Up

After setting, the single fiber is pulled out from the single-fiber collecting tank ⑩, and conveyed to the winder ⑨ for rolling to obtain the straight fiber of the artificial turf.

The conventional setting process for preparing grass fibers is oven setting, and the setting is not sufficient. In the process for preparing the nylon turf, the oven setting is replaced with water setting, and the medium is changed from air to water, so that the setting is more sufficient, and the grass fibers have a better wear resistance.

In the process for preparing nylon turf, the drawing ratio is lowered down. According to the experiments, the grass fiber has a relatively soft handfeel when the drawing ratio is from 2 to 4, and the wear resistance is better when the drawing ratio is from 3 to 5. Hence, when the drawing ratio is from 3 to 4, both of these two facts are taken into consideration. Not only the grass fiber has a soft handfeel, but also the wear resistance is improved.

In the present disclosure, the curve fiber is made from a material comprising the following raw materials parts by mass:

| | |
|---|---|
| PA or PP | 60 to 98 parts; |
| Color master batch | 2 to 6 parts; |
| Glass fiber toughening agent | 3 to 7 parts; |
| Processing agent | 1 to 5 parts. |

Therein, the processing agent is one or more selected from polymers and fluoropolymers, which mainly plays a role in maintaining the equipment.

Comparing with curve fiber prepared with raw materials of other species and amounts, the curve fiber prepared with the raw materials of the above species and amounts of the present disclosure not only has relatively good temperature resistance, but also has good wear resistance, anti-aging performance, grass fiber resilience, trampling resistance and grass uprightness at the same time.

The method for preparing curve fiber is:

mixing PA or PP, the color master batch, the glass fiber toughening agent and the processing agent, melting, extruding and thereafter cooling to obtain primary fibers;

subjecting the primary fibers to softening and drawing, deformation and rolling to obtain the curve fibers.

Figure 14:
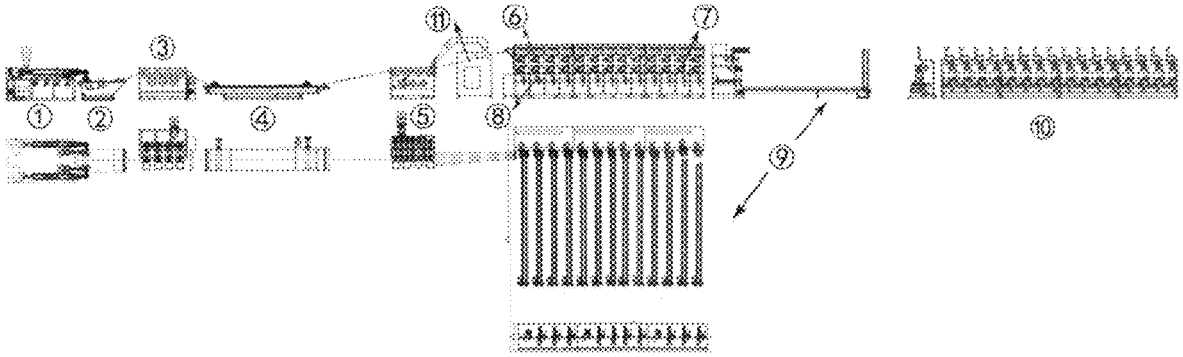
FIG. 14 is the process flow chart of preparing the curve fiber.

The method for preparing curve fibers will be illustrated in details in conjunction with the following drawings. Reference is made to FIG. 14, which is the process flow chart of preparing the curve fibers.

Step I: Melting and Extruding (1) The nylon master batch PA, color master batch, GF (glass fiber) toughening agent and process aid are mixed in proportion and transferred into the screw ① through a hopper for melting and mixing, and the resultant is uniformly and continuously extruded from the nozzles at the head of the mold.

(2) The extruded material in viscous state is put into a cooling water tank ② for cooling to form primary fiber which is the precursor of the single fiber.

(3) The primary fibers are pulled out from the cooling water tank, and sucked into the single fiber collecting tank ⑪ after passing through the first extending roller ③, the hot water tank ④ and the second extending roller ⑤, and then the primary fibers are arranged tidily in the separating groove of the cooling water tank.

Step II: Softening and Drawing (1) The speed gradually increases from the first extending roller ③ to the second extending roller ⑤, and the primary fibers are subjected to drawing to forming a single fiber.

(2) During the drawing process, the primary fibers are softened through the hot water tank ④, so that it can be uniformly and fully drawed, reducing the fracture of primary fibers during the drawing process.

Step III: Deformation (1) The stretched single fiber is pulled out from the single fiber collecting tank ⑪, successively rolled over an upper reel ⑥ and a lower reel ⑦, and passed into the deformer ⑧ to form a curve fiber.

(2) While the upper reel ⑥ and the lower reel ⑦ conveying the single fiber, the single fiber is heated to improve the activity of molecular in the single fiber.

(3) In the deformer ⑧, with the action of high temperature and atmospheric pressure, the single fiber is transformed into curve fiber by hot air extruding.

Step IV: Rolling Up (1) The deformed nylon curve fibers are transferred to a winder ⑩ by the conveyor belt ⑨ for rolling up.

(2) The nylon curve fibers are subjected to cooling and stress relief with a cooling fan over the conveyor belt ⑨ while conveying.

(3) While rolling up, the winding tension is adjusted according to the specification of the grass fiber.

The turf provided by the present disclosure further comprises a backing layer adhered on the base mat, and there is no special restriction on the species of the backing layer, and it can be any backing layer well-known to one of ordinary skill in the art.

In the present disclosure, a method for preparing the above artificial turf is also provided, which comprises:

twisting the artificial grass fibers, clustering the artificial grass fibers on base mat, applying an adhesive and then drying to obtain the artificial turf.

In the present disclosure, there is no special restriction on the method for clustering, applying the adhesive and drying, and it can be any one of the methods well-known to one of ordinary skill in the art.

Figure 15:
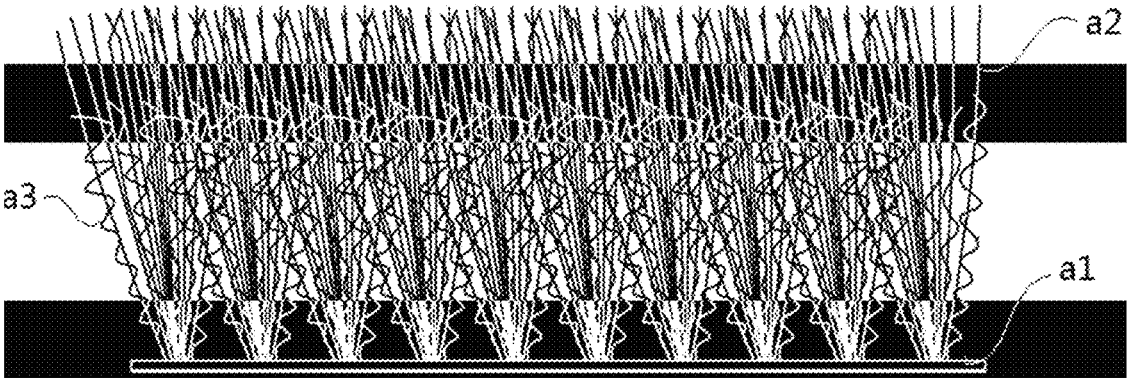
FIG. 15 is a simulation diagram showing the appearance of the artificial grass fiber provided by the present disclosure.

Reference is made to FIG. 15, which is a simulated diagram showing the appearance of the artificial grass fibers provided by the present disclosure.

In the present disclosure, nylon is used as the main material. Through choosing straight fiber with a certain cross-sectional shape, a certain length and width and cooperating with curve fiber, the obtained turf not only has relatively good temperature resistance, but also has good wear resistance, anti-aging performance, grass fiber resilience, trampling resistance and grass uprightness at the same time.

Further, in the present disclosure, through controlling the grass fiber length, fineness, different setting forms of the straight fiber and curve fiber and tuft density, the wear resistance, anti-aging performance, grass fiber resilience, trampling resistance and grass uprightness of the turf is further improved.

Further, according to the requirements of court, season and use, the color of the lawn as well as brightness or matt can be adjusted.

Further, in the present disclosure, through using a certain species of raw material and formulation, the obtained turf has good wear resistance, as well as anti-aging performance, grass fiber resilience, trampling resistance and grass uprightness.

Further, in the present disclosure, through controlling the process parameters for preparing the grass fiber, such as traction ratio and setting method, the performances of grass fiber are improved.

In order to understand the present disclosure better, the artificial grass fiber provided by the present disclosure and method for preparing the same will be illustrated in conjunction with examples hereinafter, and the protection scope of the present disclosure is not limited to the following examples.

EXAMPLE 1

Preparation of Functional Master Batch:

(1) Formulation, according to the following raw materials and mass percentages:

| | |
|---|---|
| Polyolefin resin (Jilin Petrochemical 7042): | 80%; |
| Light stabilizer 3529: | 10%; |
| Antioxidant B215: | 1%; |
| Antistatic agent JWK102: | 6%; |
| Fluoropolymer processing agent PPA2300: | 3%. |

(2) Preparation procedure: mixing the above raw materials, melting and granulating to obtain the functional master batch.

EXAMPLE 2

Preparation of the Straight Fiber (1) Formulation:

| | |
|---|---|
| PA6 | 25 kg; |
| Color master batch | 1.03 kg; |
| PA6-MDI/PTMG thermoplastic elastomer | 1.25 kg; |
| Functional master batch prepared in Example 1 | 0.75 kg; |
| Glass fiber toughening agent | 0.77 kg; |
| Anti-block agent | 0.26 kg. |

(2) Preparation procedure:

Step 1: Melting and Extruding

The above raw materials were mixed in proportion and transferred into the screw ① through a hopper for melting and mixing, and the resultant was uniformly and continuously extruded from the nozzles at the head of the mold. The aspect ratio of the screw for preparing the single-fiber of the artificial turf was 35, and the inciting and extruding temperature was 22.0° C. During the extruding process, the flow rate of the melted polyethylene resin was at 3 g/110 min.

(2) The extruded material in viscous state was put into a cooling water tank ② for cooling to form primary fiber which was the precursor of the single fiber.

(3) The primary fibers were pulled out from the cooling water tank to the drawing roller ③, and then arranged tidily in the separating groove of the cooling water tank.

Step II: Softening and Drawing (1) The primary fibers at the traction unit were sucked into the single fiber collecting tank ⑩ through hot water tank ④, dehumidifier ⑤, draft roller ⑥, hot water tank ⑦ and setting roller ⑧ in sequence.

(2) The speed gradually increases from the drawing roller ③ to drawing roller ⑥, and the primary fibers were subjected to drawing to forming a single fiber, and the draw ratio was from 3 to 4.

(3) During the drawing process, the primary fibers are softened through the hot water tank ④, so that it can be uniformly and fully stretched, reducing the fracture of primary fibers during the drawing process. The temperature of the hot water tank was 85° C.

(4) The single fiber was put into the dehumidifier ⑤ to remove the water on the surface to prevent the quality instability caused by unevenly heating during setting due to the water on the surface.

Step III: Retracting and Setting

The speed gradually reduced from the draft roller ⑥ to the setting roller ⑧, and the single fiber was subjected to retracting and setting through the oven ⑦ to give the fibers certain properties. The retraction ratio was 0.8, and the temperature of the oven was 100° C.

Step IV: Rolling Up

After setting, the single fiber was pulled out from the single-fiber collecting tank ⑩ and conveyed to the winder ⑨ for rolling to obtain the straight fiber of the artificial turf.

According to the preparation techniques above, a straight fiber was obtained with a cross-sectional shape of diamond shape, olive shape, rectangle, triangle, double-diamond (l), wave shape (h), ribbed shape (i), three-ribbed shape (k), clover shape (m), hollow shape (n), C shape (a), D shape (b), X shape, S shape (d), W shape (g), V shape (f), U shape (e) and M shape (c).

Therein, the two lengths of the diagonals of the diamond were respectively from 0.28 to 0.30 mm and from 1.2 to 1.3 mm, and the olive shape has a length of 1.5 to 1.6 mm and a diameter of 0.21 to 0.22 mm; the straight fiber has a length of 50 mm and a single-fiber denier of 1800 D. Through adjusting the type of the color master batch, straight fibers having a color of dark green, chartreuse and apple green may be obtained.

EXAMPLE 3

Preparation of the Straight Fiber:
(1) Formulation (parts by mass):

| | |
|---|---|
| PA6 | 80 parts; |
| Temperature resistance master batch | 4.2 parts; |
| PA6-MDI/PTMG thermoplastic elastomer | 5 parts; |
| Functional master batch prepared in Example 1 | 3.3 parts; |
| Glass fiber toughening agent | 5 parts; |
| Anti-block agent | 2.5 parts. |

(2) Preparation procedure:
Step I: Melting and Extruding
(1) The above raw materials were mixed in proportion and transferred into the screw ① through a hopper for melting and mixing, and the resultant was uniformly and continuously extruded from the nozzles at the head of the mold. The aspect ratio of the screw for preparing the single-fiber of the artificial turf was 35, and the melting and extruding temperature was 220° C. During the extruding process, the flow rate of the melted polyethylene resin was at 4 g/10 min.
(2) The extruded material in viscous state was put into a cooling water tank ② for cooling to form primary fibers which was the precursor of the single fiber.
(3) The primary fibers was pulled out from the cooling water tank to the drawing roller ③, and then the primary fibers was arranged tidily in the fiber-separating groove at the cooling water tank.
Step II: Softening and Drawing
(1) The primary fibers at the traction unit were sucked into the single-fiber collecting tank ⑩ through hot water tank ④, dehumidifier ⑤, draft roller ⑥, hot water tank ⑦ and setting roller ⑧ in sequence.
(2) The speed gradually increases from the drawing roller ③ to drawing roller ⑥, and the primary fibers were subjected to drawing to forming a single fiber, and the draw ratio was from 3 to 4.
(3) During the drawing process, the primary fibers are softened through the hot water tank ④, so that it can be uniformly and fully stretched, reducing the fracture of primary fibers during the drawing process. The temperature of the hot water tank was 85° C.
(4) The single fiber was put into the dehumidifier ⑤ to remove the water on the surface to prevent the quality instability caused by unevenly heating during setting due to the water on the surface.
Step III: Retracting and Setting
The speed gradually reduced from the draft roller ⑥ to the setting roller ⑧, and the single fiber was subjected to retracting and setting through the oven ⑦ to give the fibers certain properties. The retraction ratio was 0.8, and the temperature of the oven was 100° C.
Step IV: Rolling Up
After setting, the single fiber was pulled out from the single-fiber collecting tank ⑩ and conveyed to the winder ⑨ for rolling to obtain the straight fiber of the artificial turf.
According to the preparation techniques above, a straight fiber was obtained with a cross-sectional shape of diamond shape, olive shape, rectangle, triangle, double-diamond (l), wave shape (h), ribbed shape (i), three-ribbed shape (k), clover shape (m), hollow shape (n), C shape (a), D shape (b), X shape, S shape (d), W shape (g), V shape (f), U shape (e) and M shape (c).
Therein, the two lengths of the diagonals of the diamond were respectively from 0.22 to 0.24 mm and from 1.6 to 1.7 mm, and the olive shape has a length of 1.7 to 1.8 mm and a diameter of 0.31 to 0.32 mm; the straight fiber has a length of 55 mm and a single-fiber denier of 2000 D. Through adjusting the type of the color master batch, straight fibers having a color of dark green, chartreuse and apple green may be obtained.

EXAMPLE 4

Preparation of the Curve Fiber
Formulation (parts by mass):

| | |
|---|---|
| PA6 | 85 parts; |
| Color master batch | 6 parts; |
| Glass fiber toughening agent | 5.5 parts; |
| Anti-block aunt | 3.5 parts. |

(2) Preparation procedure:
Step I: Melting and Extruding
(1) The nylon master batch PA, color master batch, GF (glass fiber) toughening agent and process aid were mixed in proportion and transferred into the screw ① through a hopper for melting and mixing, and the resultant was uniformly and continuously extruded from the nozzles at the head of the mold.
(2) The extruded material in viscous state was put into a cooling water tank ② for cooling to form primary fibers which was the precursor of the single fiber.
(3) The primary fibers were pulled out from the cooling water tank, and sucked into the single fiber collecting tank ⑩ after passing through the first extending roller ③, the hot water tank ④ and the second extending roller ⑤, and then the primary fibers were arranged tidily in the separating groove of the cooling water tank.
Step II: Softening and Drawing
(1) The speeds gradually were increased from the first extending roller ③ to the second extending roller ⑤, and the primary fibers were subjected to drawing to forming a single fiber.
(2) During the drawing process, the primary fibers were softened through the hot water tank ④, so that it can be uniformly and fully stretched, reducing the fracture of primary fibers during the drawing process.
Step III: Deformation
(1) The stretched single fiber was pulled out from the single fiber collecting tank ⑪, successively rolled over an upper reel ⑥ and a lower reel ⑦, and passed into the deformer ⑧ to form a curve fiber.
(2) While the upper reel ⑥ and the lower reel ⑦ conveying the single fiber, the single fiber was heated to improve the activity of molecular in the single fiber.
(3) In the deformer ⑧, with the action of high temperature and atmospheric pressure, the single fiber was transformed into curve fiber by hot air extruding.
Step IV: Rolling Up
(1) The deformed nylon curve fibers were transferred to a winder ⑩ by the conveyor belt ⑨ for rolling up.
(2) The nylon curve fibers were subjected to cooling and stress relief with a cooling fan over the conveyor belt ⑨ while conveying.
(3) While rolling up, the winding tension was adjusted according to the specification of the grass fiber.
According to the above preparation techniques, curve fibers having a cross-sectional shape selected from olive shape, double-ribbed shape, cloned shape and multi-ribbed shape were obtained.
The olive shape has a length of 0.5 to 1.05 min and a width of 0.1 to 0.26 mm, and the double-ribbed shape has a length of 0.6 to 0.95 mm and a width of 0.16 to 0.27 mm.
The curve fiber has a length of 8 to 30 mm and a single fiber denier of 250 to 1100 D.
The color of the curve fiber may be apple green, beige or coffee.

EXAMPLE 5

According to the method in Example 4, only the PA6 in the formulation was replaced with PPY24 to give the curve fibers.

The olive shape has a length of 0.9 to 1.0 mm and a width of 0.23 to 0.24 mm; the double-ribbed shape has a length of 0.85 to 0.88 mm and a width of 0.21 to 0.22 mm.

The curve fiber has a length of 30 mm and a single fiber denier of 1000 D.

By adjusting the type of the color master batch, curve fibers having a color of apple green, beige or coffee may be obtained.

EXAMPLE 6

The straight fibers having a diamond cross-sectional shape prepared in Example 2 and the curve fibers having a olive cross-sectional shape prepared in Example 4 were ply-twisted according to an amount ratio of 1:1, clustered on the base mat to obtain a semi-finished product of the artificial turf. Therein, the tuft density was 18,900 tufts/$m^2$, the number of the artificial grass fibers was 180 tufts/m, and the stitch length was ⅜ inch.

Thereafter, an adhesive was applied to the back of the base mat of the semi-finished product, and the semi-finished product was heated in an oven to obtain the artificial turf.

The wear resistance was tested and the test method was shown hereafter:

1. Cut the samples to be tested according to the requirements, which is a shape with a size of (81±1) cm×(42±1) cm.
2. Fill rubber particles and quartz sands that met the requirements onto the samples.
3. Detect the wear resistance by a detection instrument LISPORTX with a rotation rate set at 5000.

Comment: Before the test and during each test, the height of the filler and the height of the grass fibers were measured with a vernier caliper. After each test, the loss of the filler was measured and the lost filler was refilled. Before and during each test, a photo should be taken with a camera, and the photo focused on the cracked fibers. There were at least two clear photos at each stage, one overall and the other enlarged image. The results were shown in Table 1.

EXAMPLE 7

Following the method in Example 6 and the parameters in Table 1, a different type of the artificial turf was tested while other conditions remained the same. The results were shown in Table 1. It can be concluded from Table 1 that the artificial turf provided by the present disclosure had an excellent wear resistance.

EXAMPLE 8

Following the method in Example 6 and the parameters in Table 1, a different type of the artificial turf was tested while other conditions remained the same. The results were shown in Table 1. It can be concluded from Table 1 that the artificial turf provided by the present disclosure had an excellent wear resistance.

EXAMPLE 9

Following the method in Example 6 and the parameters in Table 1, the straight fibers having a diamond cross-sectional shape prepared in Example 2 and the curve fibers having a olive cross-sectional shape prepared in Example 5 were ply-twisted according to an amount ratio of 1:1, and clustered on the base mat to give a semi-finished product of the artificial turf. The other conditions remained the same and the artificial turf was finally obtained. The wear resistance was tested, and the results were shown in Table 1.

COMPARATIVE EXAMPLES 1 to 2

Artificial turf was produced using materials different from those used in Example 6 and the parameters in Table 1 were used. The results were shown in Table 1, and the wear resistance of these artificial turfs was relatively poor.

COMPARATIVE EXAMPLES 3 to 4

Artificial turf was produced using models different from those used in Example 6 and the parameters in Table 1 were used. The results were shown in Table 1, and the wear resistance of these artificial turfs was relatively poor.

COMPARATIVE EXAMPLE 5

Following the method in Example 2, straight fibers with a size that was different from that of Example 2 were obtain, of which the two diagonals of the diamond shape were respectively 0.4 mm and 1.9 mm. The olive shape has a length of 1.1 mm and a diameter of 0.38 mm.

The straight fibers have a length of 62 mm and a single fiber denier of 2200 D.

COMPARATIVE EXAMPLE 6

Following the method in Example 4, straight fibers with a size that was different from that of Example 4 were obtained. The olive shape has a length of 1.5 mm and a width of 0.3 mm and the double-ribbed shape has a length of 1.0 mm and a width of 0.13 mm.

The curve fibers have a length of 35 mm and a single fiber denier of 1200 D.

COMPARATIVE EXAMPLE 7

Following the method in Example 6, the straight fibers having a diamond cross-sectional shape prepared in Comparative Example 5 and the curve fibers having a olive cross-sectional shape prepared in Comparative Example 6 were ply-twisted according to an amount ratio of 1:1, and then clustered on the base mat to give a semi-finished product of the artificial turf. The other conditions remained the same and the artificial turf was finally obtained. The wear resistance was tested, and the results were shown in Table 1.

COMPARATIVE EXAMPLE 8

The straight fibers having a diamond cross-sectional shape prepared in Example 2 and the curve fibers having an olive cross-sectional shape prepared in Example 4 were ply-twisted according to an amount ratio of 1:1, and then clustered on the base mat to give a semi-finished product of the artificial turf. Therein, the tuft density was 26,775 tufts/$m^2$, the number of the artificial grass fibers was 255 tufts/m, and the stitch length was ⅜ inch.

TABLE 1

Test results of the wear resistance of the artificial turfs

| | Material | Shape of straight fiber | Shape of curve fiber | Main Material | Fill Ratio | Wear Resistance Status |
|---|---|---|---|---|---|---|
| Comparative Example 1 | PE | Diamond | Olive | 2607G | 20:10 | A few split ends at a rotation rate of 50,000; many split ends at a rotation rate of 35,000; a lot split ends at a rotation rate of 80,000; poor lodging resistance. |
| Comparative Example 2 | PE | Olive | Olive | 2607G | 20:10 | A few split ends at a rotation rate of 50,000, many split ends at a rotation rate of 100,000; poor lodging resistance. |
| Example 6 | Nylon | Diamond | Olive | PA | 20:10 | Almost no split end at a rotation rate of 150,000; good erectability. |
| Example 7 | Nylon | Olive | Olive | PA | 20:10 | Almost no split end at a rotation rate of 200,000; good erectability. |
| Example 8 | Nylon | Diamond | Double-ribbed | PA | 20:10 | Almost no split end at a rotation rate of 200,000; good erectability. |
| Example 9 | PA + PP | Diamond | Olive | PA | 20:10 | Almost no split end at a rotation rate of 150,000; good erectability. |
| Comparative Example 3 | Nylon | C | Olive | PA | 20:10 | A few split ends at a rotation rate of 25,000; many split ends at a rotation rate of 40,000; poor lodging resistance. |
| Comparative Example 4 | Nylon | S | Olive | PA | 20:10 | A few split ends at a rotation rate of 30,000 and abnormal shapes of fibers; many split ends at a rotation rate of 50,000; poor lodging resistance. |
| Comparative Example 7 | Nylon | Diamond | Olive | PA | 20:10 | A few split ends at a rotation rate of 50,000; good erectability. |
| Comparative Example 8 | Nylon | Diamond | Olive | PA | 20:10 | A few split ends at a rotation rate of 120,000; good erectability. |

Comment

1. The filler was refilled every 5000 rounds, and the erectability and the split ends of the turf were observed.
2. The wear resistance of moving product with a nylon material was much better than that of a pure PE material (C6 material).
3. When the nylon materials were the same, among different shapes, fibers in diamond shape and olive shape have a better wear resistance than the one with other shapes.
4. The fill ratio was 20 kg of quartz sands:10 kg of rubber particles.

EXAMPLE 10

The straight fibers having a cross-sectional shape of S shape prepared in Example 3 and the curve fibers having a olive cross-sectional shape prepared in Example 4 were ply-twisted according to an amount ratio of 1:1, and then clustered on the base mat to give a semi-finished product of the artificial turf. Therein, the tuft density was 18,900 tufts/m$^2$, the number of the artificial grass fibers was 180 tufts/m, and the stitch length was ⅜ inch.

Adhesive was applied to the base mat of the semi-finished product of the artificial turf, and the artificial turf was obtained after heating in an oven.

Test of the temperature resistance of the artificial turf

Test Method:

1. Sampling: 6 pieces of turf samples with different materials of PE/PE+PP/PA+PP/PA were taken in a size of 10 cm×10 cm and marked.

2. Test: The temperature of the oven was set as 85° C./95° C./105° C./115° C./125° C./135° C., respectively. After the oven reached the preset temperature, the marked turfs made from different materials were disposed in the oven and taken out 1 hour later.

3. Results: The samples were taken out and cooled down for 1 hour, and then the height of the fibers was measured and recorded.

Test results evaluation: with the changing of the temperature, the smaller the change of height of the straight fibers, the better the temperature resistance of the product, on the contrary, the worse the temperature resistance of the product.

TABLE 2

Test results of the temperature resistance of the artificial turfs

| | Sample | | | |
|---|---|---|---|---|
| ° C. | Retraction Ratio of Comparative Example 9 (%) | Retraction Ratio of Comparative Example 10 (%) | Rettaction Ratio of Example 11 (%) | Retraction Ratio of Example 10 (%) |
| 85 | 3.5-5.0 | 5.0-9.5 | 2.0-2.5 | 2.0-2.5 |
| 95 | 4.5-15 | 7.0-20 | 2.0-2.5 | 1.5-3.0 |
| 105 | 7.5-25 | 12-30 | 1.5-2.0 | 2.0-2.5 |
| 115 | 13-30 | 18-45 | 2.0-3.0 | 1.0-2.0 |
| 125 | 18-40 | 23-50 | 2.0-2.5 | 1.5-2.0 |
| 135 | 20-60 | 30-60 | 2.5-3.0 | 2.5-3.0 |

EXAMPLE 11

The straight fibers having a clover cross-sectional shape prepared in Example 3 and the curve fibers having a double-ribbed cross-sectional shape prepared in Example 5 were ply-twisted according to an amount ratio of 1:1, and then clustered on the base mat to give a semi-finished product of the artificial turf. Therein, the tuft density was 16,800 tufts/m$^2$, the number of the artificial grass fibers was 160 tufts/m, and the stitch length was ⅜ inch.

Adhesive was applied to the base mat of the semi-finished product of the artificial turf, and the artificial turf was obtained after heating in an oven.

COMPARATIVE EXAMPLE 9

The artificial turf was prepared by the method in Example 7, wherein PA in the row materials of straight fibers and the curve fibers was replaced with PE, while other conditions remained the same. The results were shown in Table 2.

COMPARATIVE EXAMPLE 10

The artificial turf was prepared by the method in Example 7, wherein PA in the material of straight fibers was replaced with PE and PA in the material of curve fibers was replaced with PP, while other conditions remained the same. The results were shown in Table 2.

COMPARATIVE EXAMPLE 11

The straight fibers were prepared by the method in Example 2, except that PA6 was replaced with PE. In the process technique, the melting and extruding temperature was adjusted to 240° C. In the Step 11, the hot water tank used for softening and drawing was 105° C. The other conditions remained the same, to give a PE straight fiber.

EXAMPLE 12

The grass fibers of the above examples were subjected to an anti-aging test, and the result was shown in Table 3.

Therein, the anti-aging test was carried out according to the EN14836-2005 standard. The tensile strength retention of the grass fibers was tested according to the GB/T20394-2013.

TABLE 3

Test results of the anti-aging performance of grass fibers

| Test Item | Sample | | | | |
|---|---|---|---|---|---|
| | Example 2/ Nylon straight fibers | Example 3/ Nylon straight fibers | Comparative Example 11/PE straight fibers | Example 4/ Nylon straight fibers | Example 5/ PP curve fibers |
| Model | Diamond | Diamond | Diamond | Olive shape | Olive shape |
| Denier of single fiber | 900D | 900D | 900D | 450D | 450D |
| Test data of the anti-aging test (3000h) | 3528h | 3460h | 3048h | 3019h | 2945h |

The above description is only preferred embodiments of the present disclosure. It should be noted that a number of modifications and refinements may be made by one of ordinary skill in the art without departing from the principles of the present disclosure, and such modifications and refinements are also considered to be within the scope of the disclosure.

What is claimed is:

1. An artificial turf, comprising a base mat, artificial grass fibers clustered on the base mat and a backing layer adhered to the back side of the base mat, wherein the artificial grass fiber comprises a straight fiber and a curve fiber, and the material of the straight fiber is Polyamide, and the material of the curve fiber is at least one selected from Polyamide and Polypropylene, wherein the turf density of the artificial grass fiber is from 7560 to 25200 tufts/$m^2$, the straight fiber has a length of 12 to 60 mm, and a single-fiber denier of 500 to 2000 D; and the curve fiber has a natural length of 8 to 30 mm and a single-fiber denier of 250 to 1100 D;

wherein the straight fiber is made from a material comprising the following raw materials parts by mass:

| | | |
|---|---|---|
| Polyamide | 70 to 90 | parts; |
| Color master batch or temperature resistance master batch | 2 to 8 | parts; |
| Polyamide-Diphenyl-methane-diisocyanate/ polytetramethylene ether glycol thermoplastic elastomer | 3 to 10 | parts; |
| Functional master batch | 2 to 10 | parts; |
| Glass fiber toughening agent | 5 to 10 | parts; |
| Processing agent | 1 to 3 | parts; |

wherein the functional master batch is obtained by mixing and granulating a material comprising the following raw materials by weight percentage;

| | |
|---|---|
| Polyolefin resin | 50 wt % to 80 wt %; |
| Light stabilizer | 1 wt % to 10 wt %; |
| Antioxidant | 1 wt % to 10 wt %; |
| Antistatic agent | 1 wt % to 15 wt %; |
| Plasticizer | 0.5 wt % to 5 wt %; |

and the processing agent is one or more selected from silicone polymers and fluoropolymers; and wherein the method for preparing the straight fibers is:

mixing Polyamide, the color master batch or the temperature resistance master batch, Polyamide-Diphenyl-methane-diisocyanate/polytetramethylene ether glycol thermoplastic elastomer, the glass fiber toughening agent and the processing agent, melting, extruding and thereafter cooling to obtain primary fibers;

subjecting the primary fibers to softening, drawing, shrinkage, setting and winding to obtain the straight fibers; the draw ratio of the drawing is from 3 to 4.

2. The artificial turf according to claim 1, wherein the straight fiber has at least one cross-sectional shape, and the curve fiber has at least one cross-sectional shape.

3. The artificial turf according to claim 2, wherein the cross-sectional shape of the straight fiber is one or more selected from diamond shape, olive shape, rectangle, triangle, double-diamond shape, wave shape, ribbed shape, three-ribbed shape, clover shape, hollow shape, C shape, D shape, X shape, S shape, W shape, V shape, U shape and M shape; the cross-sectional shape of the curve fiber is one or more selected from rectangle, diamond shape, olive shape and ribbed shape; and the straight fiber and/or the curve fiber have a bright and/or matt surface effect.

4. The artificial turf according to claim 2, wherein the cross-sectional shape of the straight fiber is diamond and/or olive shape, and the lengths of two diagonals of the diamond shape are respectively from 0.1 to 0.39 mm and from 1.0 to 1.8 mm, and the olive shape has a length of 1.2 to 2.0 mm and a diameter of 0.17 to 0.36 mm; the cross-sectional shape of the curve fiber is selected from olive shape and/or ribbed shape, and the ribbed shape is one or more selected from single-ribbed shape, double-ribbed shape, multiple-ribbed shape and connected-ribbed shape, and the olive shape has a length of 0.5 to 1.05 mm and a diameter of 0.1 to 0.26 mm, and the ribbed shape has a length of 0.6 to 0.95 mm and a width of 0.16 to 0.27 mm.

5. The artificial turf according to claim 1, wherein the artificial grass fibers have at least two colors.

6. The artificial turf according to claim 1, wherein the amount ratio of the straight fiber in use to the curve fiber in use is 1:1.

7. The artificial turf according to claim 1, wherein the number of the artificial grass fiber is from 120 to 240 tufts/m, and the stitch length is ⅜ or ⅝ inch.

8. The artificial turf according to claim 1, wherein the curve fiber is made from a material comprising the following raw materials parts by mass:

| | | |
|---|---|---|
| Polyamide or Polypropylene | 60 to 98 | parts; |
| Color master batch | 2 to 6 | parts; |
| Glass fiber toughening agent | 3 to 7 | parts; |
| Processing agent | 1 to 5 | parts. |

9. The artificial turf according to claim 8, wherein the method for preparing the curve fibers is:

mixing Polyamide or Polypropylene, the color master batch, the glass fiber toughening agent and the processing agent, melting, extruding and thereafter cooling to obtain primary fibers;

subjecting the primary fibers to softening and drawing, deformation and rolling to obtain the curve fibers.

10. A method for preparing the artificial turf according to claim 1, comprising the following steps:

twisting the artificial grass fibers, clustering the artificial grass fibers on the base mat, applying an adhesive and then drying to obtain the artificial turf.

* * * * *